US005887443A

United States Patent [19]

Lee et al.

[11] Patent Number: 5,887,443

[45] Date of Patent: Mar. 30, 1999

[54] DEFROST CONTROL METHOD AND APPARATUS OF REFRIGERATOR

[75] Inventors: Gihyeong Lee, Seoul; Chiseong Oh, Suwon, both of Rep. of Korea

[73] Assignee: Samsung Electronics Co., Ltd., Suwon, Rep. of Korea

[21] Appl. No.: 975,104

[22] Filed: Nov. 20, 1997

[51] Int. Cl.[6] ..... F25D 21/06

[52] U.S. Cl. ..... 62/153; 62/155; 62/156

[58] Field of Search ..... 62/156, 151, 153, 62/155, 234, 154, 80

[56] References Cited

U.S. PATENT DOCUMENTS

| | | | |
|---|---|---|---|
| 4,297,852 | 11/1981 | Brooks | 62/153 |
| 4,327,557 | 5/1982 | Clarke et al. | 62/156 X |
| 4,481,785 | 11/1984 | Tershak et al. | 62/155 X |
| 5,228,300 | 7/1993 | Shim | 62/153 |
| 5,483,804 | 1/1996 | Ogawa et al. | 62/153 |
| 5,564,297 | 10/1996 | Suse | 62/153 |

*Primary Examiner*—Harry B. Tanner

*Attorney, Agent, or Firm*—Burns, Doane, Swecker & Mathis, L.L.P.

[57] ABSTRACT

A defrost control method and apparatus for a refrigerator having a defrosting heater for defrosting the evaporator. The method classifies a plurality of operating condition cases based on outside temperature of the cabinet and door opening number. Each of the operating condition cases has a predetermined severity factor. It is obtained a frosting weight for the unit time interval by multiplying a compressor operating time with the severity factor of the operating condition case. The frosting weights for a plurality of the unit time interval are accumulated and a defrosting operation is performed when the accumulated frosting weight exceeds a predetermined value.

6 Claims, 3 Drawing Sheets

| OUTSIDE TEMPERATURE / DOOR OPENING NUMBER / 1 HOUR | HIGH | MIDDLE | LOW |
|---|---|---|---|
| 5 TIMES OR MORE | CASE1 | CASE2 | CASE2 |
| LESS THAN 5 TIMES | CASE2 | CASE2 | CASE3 |

| DOOR OPENING NUMBER / 1 HOUR \ OUTSIDE TEMPERATURE | HIGH | MIDDLE | LOW |
|---|---|---|---|
| 5 TIMES OR MORE | CASE1 | CASE2 | CASE2 |
| LESS THAN 5 TIMES | CASE2 | CASE2 | CASE3 |

DEFROST CONTROL METHOD AND APPARATUS OF REFRIGERATOR

BACKGROUND OF THE INVENTION

The present invention relates to a defrost control method and apparatus of a refrigerator.

A refrigerator generally includes a cabinet in which food storage compartments such as a refrigerating compartment and a freezing compartment are formed, a cooling system for cooling food stored in the food storage compartments and doors for opening and closing the refrigerating and freezing compartments. The cooling system includes a compressor for compressing a refrigerant, a condenser for condensing the refrigerant from the compressor and an evaporator for evaporating the refrigerant from the condenser to generate a cool air. The evaporator generates the cool air by cooing the ambient air by evaporation latent heat of the refrigerant flowing inside the evaporator. The thus-generated cool air is supplied to the refrigerant and freezing compartments by a blowing fan.

In such a refrigerator, moisture is condensed and freezed on the surface of the evaporator by the difference of relative humidities between the surface of the evaporator having a relatively low temperature and the ambient air having a relatively high temperature, to thereby generator frost. The frost formed on the surface of the evaporator hinders thermal exchange of the evaporator, thereby lowering the cooling efficiency and increasing power consumption. In order to overcome the problem, a refrigerator having a defrosting heater adjacent to an evaporate to remove frost formed on the surface of the evaporator has been developed recently.

The amount of frost formed on the surface of the evaporator is proportional to the operation time of the compressor and increases according as inflow of ambient air into the refrigerator increases by opening of the doors. That is, the amount of frost depends on the operation time of the compressor, the number and time of the door opening and the temperature of ambient air. Considering these factors, various defrost time determining methods are proposed.

A defrost time determining method disclosed in U.S. Pat. No. 4,297,852 determines as a defrost time when the sum of the operation time of a compressor is above a predetermined value and then the sum of the door opening time reaches a reference value. However, this method does not consider the affect of the temperature of ambient air.

Another defrost time determining apparatus disclosed in U.S. Pat. No. 5,564,286 includes as elements thereof a compressor operation timer, a door opening counter, a door opening timer and an outside temperature sensor and determines a defrost time according to fuzzy logic reasoning using values measured by the elements. Here, after compressor operation time passes a predetermined time, the defrost time is judged based on the door opening number and the outside temperature. On the other hand, the defrost operation is independently performed when the sum of the door opening time is above a reference value without consideration of other operating conditions. However, this apparatus has a drawback that the process of determining the defrost time is relatively complicated.

SUMMARY OF THE INVENTION

It is an object of the present invention to provide a defrost control method and apparatus for a refrigerator which is capable of determining the defrost time of the refrigerator simply and efficiently.

To accomplish the above object, there is provided a defrost control method for a refrigerator having a cabinet forming food storage compartment, a door for the food storage compartment, a compressor, an evaporator and a defrosting heater for defrosting the evaporator, comprising the steps of: classifying a plurality of operating condition cases based on outside temperature of the cabinet and door opening number for a unit time interval, each of the operating condition cases being given a predetermined severity factor; measuring outside temperature, door opening number, compressor operating time during the unit time interval; obtaining a frosting weight for the unit time interval by multiplying the compressor operating time with the severity factor of the operating condition case corresponding to the outside temperature and the door opening number; accumulating the frosting weights for a plurality of the unit time interval; and performing a defrosting operation when the accumulated frosting weight exceeds a predetermined value.

Preferably, the method further comprises measuring door opening time for every door opening, and increasing the door opening number when the door opening time exceeds every a predetermined time.

There is also provided a defrost control apparatus for a refrigerator having a cabinet forming food storage compartment, a door for the food storage compartment, a compressor, an evaporator and a defrosting heater for defrosting the evaporator, comprising: an outside temperature sensor for detecting a temperature outside the cabinet; a door opening counter 24 for counting a opening number of the door; a compressor operating timer for measuring an operating time of the compressor; a controller for calculating the compressor operating time with a severity factor predetermined based on the outside temperature and the door opening number for a unit time interval to obtain a unit frosting weight, accumulating the unit frosting weights for a plurality of the unit time intervals, and determining a defrosting time when the accumulated frosting weight exceeds a predetermined value to control the defrosting heater.

BRIEF DESCRIPTION OF THE DRAWINGS

The above object and advantage of the present invention will become apparent by describing in detail a preferred embodiment thereof with reference to the accompanying drawings in which.

DETAILED DESCRIPTION OF THE INVENTION

Figure 1:
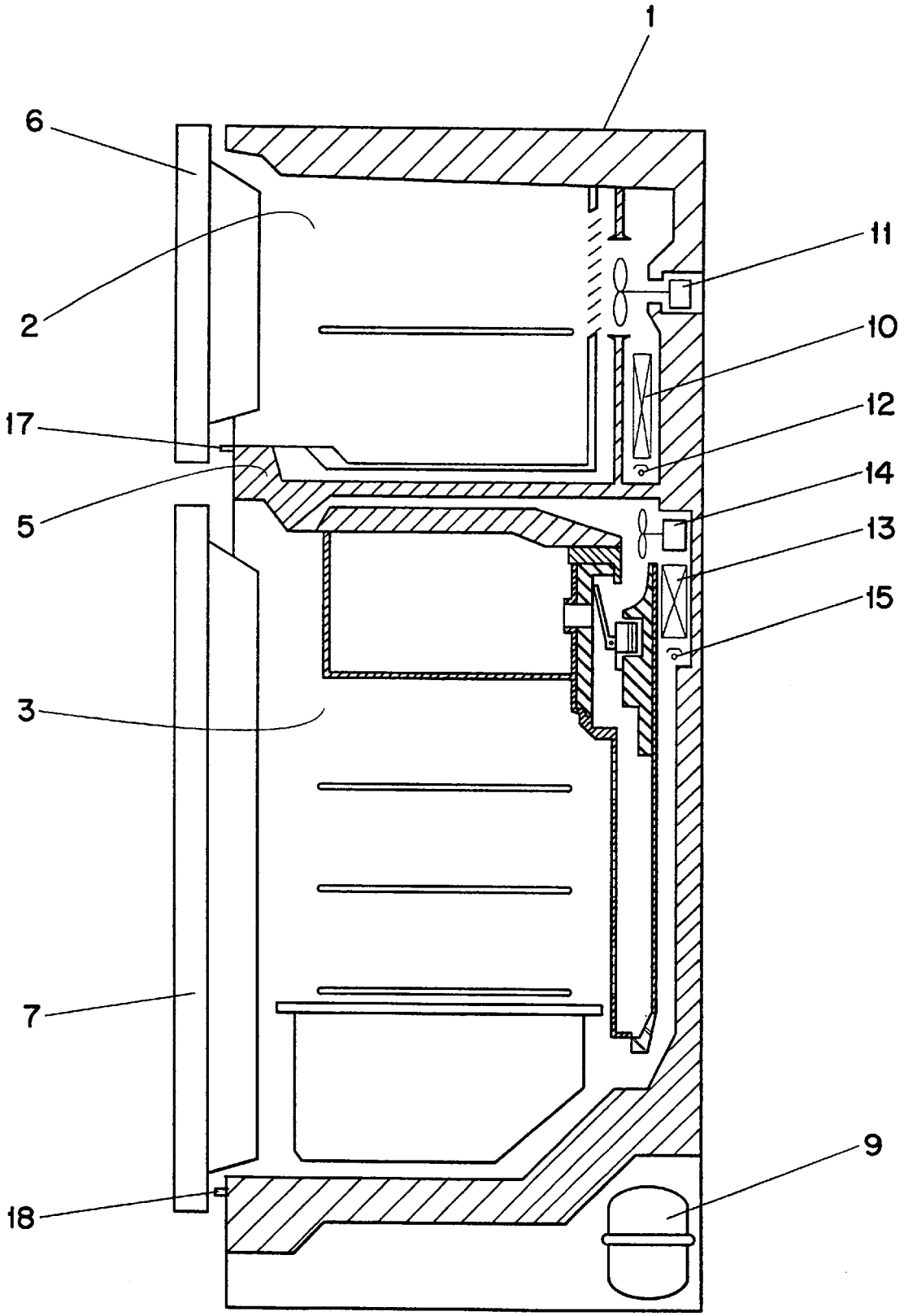
FIG. 1 shows a sectional view of a refrigerator having a defrost control apparatus according to the present invention.

Referring to FIG. 1, a refrigerator having a defrost control apparatus according to the present invention includes a cabinet 1 provided with an upper freezing compartment 2 and a lower refrigerating compartment 3 which are separated from each other by a partitioning wall 5. Doors 6 and 7 are provided at the front sides of the freezing and refrigerating compartments 2 and 3, respectively.

The refrigerator employs a so-called independent cooling system, in which a freezing compartment evaporator 10 and a refrigerating compartment evaporator 13 are associated with the freezing and refrigerating compartments 2 and 3, respectively. A compressor 9 for compressing a refrigerant is installed at a rear lower portion of the cabinet 1. The refrigerant from the compressor 9 is transferred to the evaporators 10 and 13 via a condenser (not shown). Cool air generated by the evaporators 10 and 13 is supplied into the freezing and refrigerating compartments 2 and 3 by blowing fans 11 and 14. Defrosting heaters 12 and 15 are disposed under the evaporators 10 and 13 to remove frost formed on the surfaces of the evaporators 10 and 13, respectively.

Door switches 17 and 18 are provided at the front sides of the freezing and refrigerating compartments 2 and 3, under the respective doors 6 and 7 to detect the opening of the doors 6 and 7. Opening signals detected by the door switches 17 and 18 are transmitted to the door opening counter and door opening timer (described later).

It will be easily understood that the defrost control apparatus of the present invention is not limited to the independent cooling system. Hereinafter, the operation of the defrost control apparatus will be described with regard to the freezing compartment evaporator 10 for the convenience of description.

Figures 2, 3:
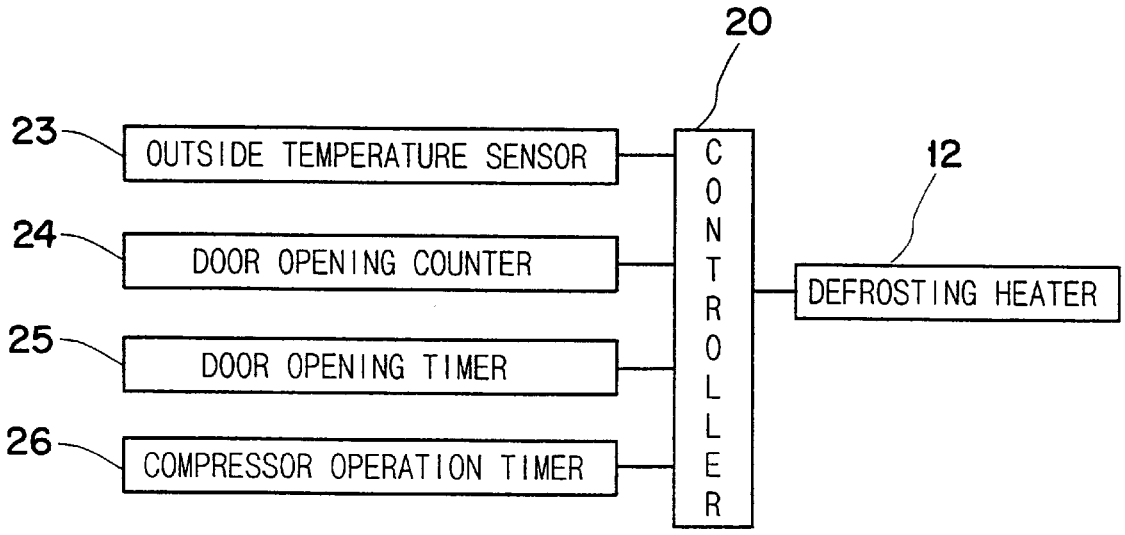
FIG. 2 shows a schematic block diagram of the defrost control apparatus according to the present invention.
FIG. 3 is a table showing a example of operating condition cases applied in the defrost control apparatus according to the present invention.

As shown in FIG. 2, the present defrost control apparatus includes a controller 20 for controlling the defrosting heater 12. An outside temperature sensor 23, a door opening counter 24, a door opening timer 25 and a compressor operation timer 26 supply input signals to the controller 20.

The outside temperature sensor 23 detects temperature outside the cabinet 1 and transmits a temperature signal to the controller 20. The door opening counter 24 counts the number of door opening timer 25 according to the opening measures the signal from the door switch 17, and the doo ropening timer 25 measures the opening time of the door 6 according to the opening signal from the door switch 17. The door opening number and time are transmitted to the controller 20. The compressor operation timer 26 accumulates the operating time of the compressor 9 which operates intermittently according to temperature inside the freezing compartment 2.

The controller 20 stores an information regarding a plurality of operating condition cases which are classified according to operating conditions of the refrigerator. An example of the classification of the operating condition cases is shown in a table of FIG. 3 which classify the cases based on the outside temperature and the door opening number in consideration of severity increasing the forming of the frost.

FIG. 3 shows an example of the operating condition cases classification remarkably simplified for the convenience of description. The cases are classified in the basis of experimental results. Case 1 corresponds to that the door 6 opens 5 times or more in a high outside temperature state. Case 2 means that the door 6 opens less than 5 times in the high outside temperature state or the the door 6 opens 5 times or more in a low outside temperature state. In a middle outside temperature state, the operating condition case always corresponds to Case 2. Case 1 is applied to a door opening number of less than 5 times in the low outside temperature state.

It is also assumed that the defrosting should be performed when the operating conditions corresponding to Case 1, Case 2 and Case 3 have continued for 6 hours, 12 hours and 16 hours, respectively. That is, the more often the door opening in a higher outside temperature is, the shorter the defrosting period is. A reciprocal number of the defrosting periods, that is $1/6$, $1/12$ or $1/16$ means for severity influencing the frosting.

It can be easily understood that the classification of the example of FIG. 3 may be subdivided driven by needs.

The controller 20 evaluates a signal concerning the door opening time from door opening timer 25 and increases the door opening number when the door opening time exceeds every a predetermined time, for example 10 to 20 seconds, preferably 15 seconds. For example, if the door is opened for 50 seconds (exceeding three 15 seconds) in one door opening, the door opening number is evaluated as (1+3)=4.

The controller 20 determines the operating condition case based on the evaluated door opening number and the outside temperature for a unit time interval, for example 1 hour, from FIG. 3. The severity factor, that is the reciprocal number of the defrosting period corresponding the determined case is multiplied to the compressor operating time to obtain frosting weight for the unit time interval. The frosting weights for several unit time intervals are accumulated until the sum of the frosting weights reaches "1" or more. When the sum of the frosting weights exceeds "1", the controller 20 determined the time as a time that the defrosting shall be performed.

For example, if the compressor operates for 30 minutes under an operating condition of Case 2 during a first 1 hour and for 30 minutes under an operating condition of Case 1 during a second 1 hour, the sum of the frosting weights will be (0.5/12+0.5/6)=1.5/12.

Figure 4:
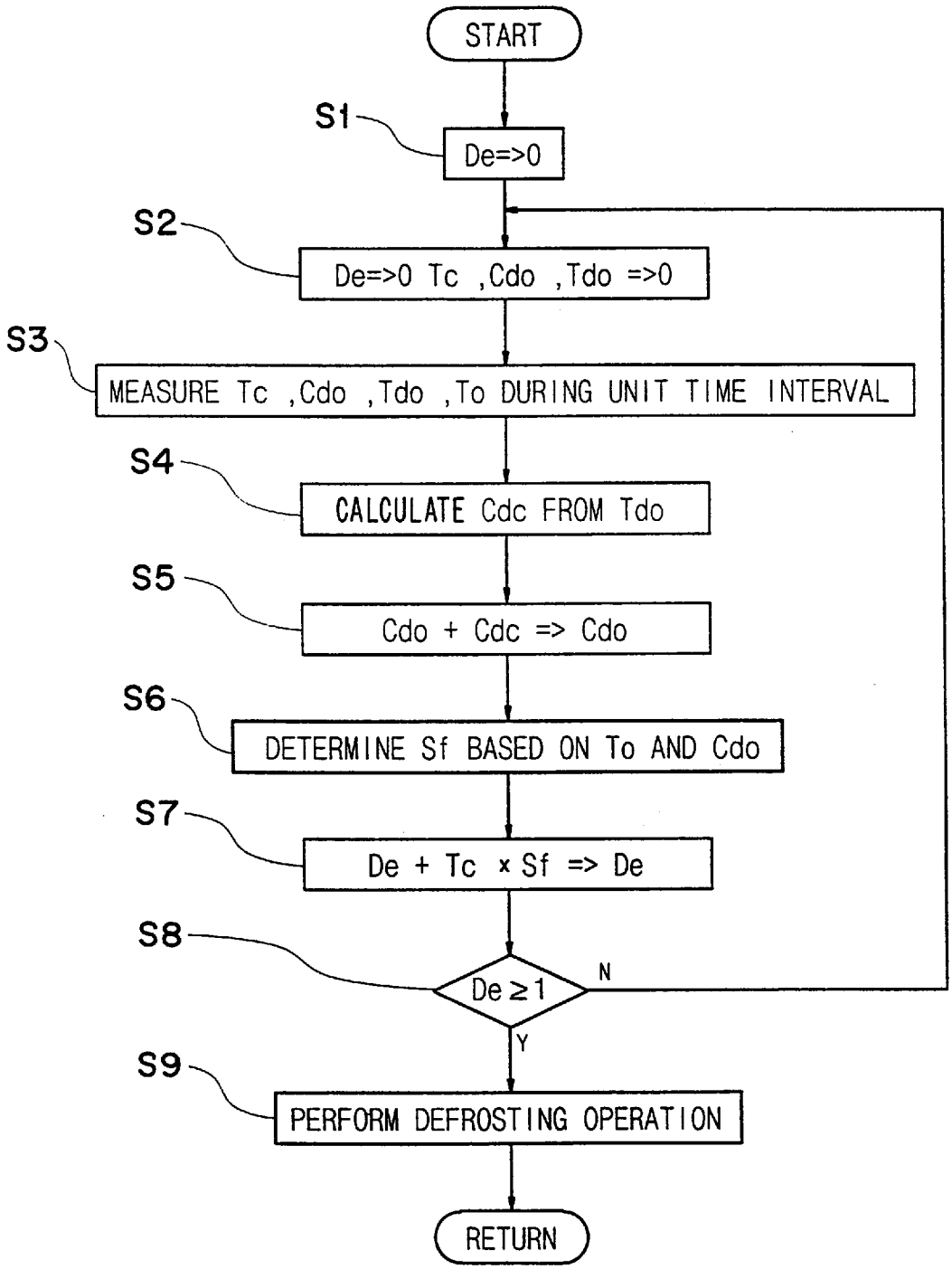
FIG. 4 shows a flow chart of a defrost control method according to the present invention.

FIG. 4 shows a flow chart of a defrost control method according to the present invention. When the refrigerator starts initially, the total frosting weight De is reset to "0"(S1), and compressor operating time tc, door opening number Cdo and door opening time tdo are also reset to "0"(S). Then, for a unit time interval of 1 hour, the outside temperature sensor 23, the door opening counter 24, the door opening time 25 and the compressor operating timer 26 measure outside temperature To, door opening number Cdo, door opening time tdo and compressor operating time tc, respectively (S3).

The controller 20 convert the door opening time tdo from the step S3 into a converted door opening number Cdc(S4). As described above, the converted door opening number Cdc increases 1 time when the door opening time tdo exceeds every 15 seconds. The converted door opening number Cdc is added to the door opening number Cdo(S5). Based on the door opening number Cdo and the outside temperature To, the operating condition case is determined from the table of the FIG. 3 to obtain the severity factor Sf(S6). A unit frosting weight is obtained by multiplying the severity factor Sf to the compressor operating time tc. The unit frosting weight is accumulated to the total frosting weight De(S7). If the total frosting weight De is less than "1"(S8), the steps S2 to S7 are repeated to obtain another unit frosting weight for a next 1 hour and a new total frosting weight. If the total frosting weight De is higher than "1"(S8), the defrosting operation is performed(S9). After the defrosting operation is completed, the routine returns to S1.

As described above, according to the invention, the unit frosting weight for a unit time interval is calculated based on outside temperature, door opening number, door opening time and compressor operating time, and the unit frosting weights for several unit time intervals are accumulated to be used in determining defrosting time. Accordingly, the defrosting time is determined effectively in consideration of all factors, influencing the frosting.

What is claimed is:

1. A defrost control method for a refrigerator having a cabinet forming food storage compartment, a door for the food storage compartment, a compressor, an evaporator and a defrosting heater for defrosting the evaporator, comprising the steps of:

classifying a plurality of operating condition cases based on outside temperature of the cabinet and door opening number for a unit time interval, each of the operating condition cases being given a predetermined severity factor;

measuring outside temperature, door opening number, compressor operating time during the unit time interval;

obtaining a frosting weight for the unit time interval by multiplying the compressor operating time with the severity factor of the operating condition case corresponding to the outside temperature and the door opening number;

accumulating the frosting weights for a plurality of the unit time interval; and performing a defrosting operation when the accumulated frosting weight exceeds a predetermined value.

2. The defrost control method according to claim 1, further comprising measuring door opening time for every door opening, and increasing the door opening number when the door opening time exceeds every a predetermined time.

3. The defrost control method according to claim 2, wherein the predetermined time is 10 to 20 seconds.

4. The defrost control method according to claim 1, further comprising predetermined defrosting periods for the operating condition cases, and applying the reciprocal number of the defrosting periods to the severity factor.

5. A defrost control apparatus for a refrigerant having a cabinet forming food storage compartment, a door for the food storage compartment, a compressor, an evaporator and a defrosting heater for defrosting the evaporator, comprising:

an outside temperature sensor for detecting a temperature outside the cabinet;

a door opening counter 24 for counting an opening number of the door;

a compressor operating time for measuring an operating time of the compressor;

a controller for calculating the compressor operating time with a severity factor predetermined based on the outside temperature and the door opening number for a unit time interval to obtain a unit frosting weight, accumulating the unit frosting weights for a plurality of the unit time intervals, and determining a defrosting time when the accumulated frosting weight exceeds a predetermined value to control the defrosting heater.

6. The defrost control apparatus according to claim 5 further comprising a door opening timer for measuring a opening time of the door, wherein the controller increases the door opening number when the door opening time exceeds every a predetermined time.

* * * * *